US008806837B2

(12) United States Patent
Stone

(10) Patent No.: US 8,806,837 B2
(45) Date of Patent: Aug. 19, 2014

(54) CEILING PLANK

(71) Applicant: Norman Stone, Harrison, NY (US)

(72) Inventor: Norman Stone, Harrison, NY (US)

(73) Assignee: Tower Ipco Company Limited, Dublin (IE)

( * ) Notice: Subject to any disclaimer, the term of this patent is extended or adjusted under 35 U.S.C. 154(b) by 0 days.

(21) Appl. No.: 13/857,625

(22) Filed: Apr. 5, 2013

(65) Prior Publication Data

US 2013/0269280 A1 Oct. 17, 2013

Related U.S. Application Data

(60) Provisional application No. 61/624,500, filed on Apr. 16, 2012.

(51) Int. Cl.
*E04B 1/00* (2006.01)
*E04F 13/08* (2006.01)

(52) U.S. Cl.
CPC ..... *E04F 13/0823* (2013.01)
USPC ..... 52/741.1; 52/489.2; 52/775

(58) Field of Classification Search
USPC ..... 52/483.1–489.2, 774, 775, 747.1
See application file for complete search history.

(56) References Cited

U.S. PATENT DOCUMENTS

| | | | | |
|---|---|---|---|---|
| 2,174,145 | A * | 9/1939 | Tummins | 52/489.2 |
| 2,234,114 | A * | 3/1941 | Gifford | 52/483.1 |
| 2,281,519 | A * | 4/1942 | Faber | 52/512 |
| 2,317,428 | A * | 4/1943 | Anderson | 52/509 |
| 2,335,303 | A * | 11/1943 | Olsen | 52/512 |
| 3,187,389 | A * | 6/1965 | Anderson | 52/489.1 |
| 4,444,524 | A * | 4/1984 | Cook et al. | 403/387 |
| 6,079,177 | A * | 6/2000 | Halchuck | 52/506.06 |
| 6,612,077 | B2 * | 9/2003 | Parshad | 52/36.5 |
| 7,886,494 | B1 * | 2/2011 | Schott | 52/489.1 |
| D671,816 | S | 12/2012 | Stone | |
| 2007/0266666 | A1 | 11/2007 | Dammers | |

FOREIGN PATENT DOCUMENTS

| | | | |
|---|---|---|---|
| DE | WO2006032378 | A1 | 3/2006 |
| DE | WO2011006813 | A2 | 1/2011 |
| DE | 202012100659 | U1 | 5/2012 |

OTHER PUBLICATIONS

Armstrong—Wood Haven Ceiling Plank Installation Instructions (3 pages) published prior to the Apr. 5, 2013 file date of the present U.S. Appl. No. 13/857,625.

* cited by examiner

*Primary Examiner* — William Gilbert
*Assistant Examiner* — Gisele Ford
(74) *Attorney, Agent, or Firm* — Rodman & Rodman

(57) ABSTRACT

An elongated generally rectangular ceiling plank formed of wood or plastic composition and has opposite elongated side edges with a length that is between nine and ten times the width of the opposite end edges. The ceiling plank includes complementary tongue and groove engagement portions formed at the sides and ends for side-by-side or end-to-end engagement with other similar planks. In a ceiling plank installation a ceiling plank securement clip secures the side groove portion of one plank to a ceiling. The secured plank can be joined to another plank in side-by-side or end-to-end engagement at a ceiling by interengagement with the tongue portion at the side or end of the other plank. The ceiling plank is approximately forty-eight inches long and five inches wide and can thus be easily handled and installed by one person.

8 Claims, 5 Drawing Sheets

CEILING PLANK

BACKGROUND OF THE INVENTION

Field of the Invention

This invention is directed a ceiling plank for a plank ceiling installation, and more particularly to a novel ceiling plank that can he easily handled and installed by one person.

It is known to make ceiling planks with a highly elongated structure, typically measuring approximately 5 inches by 84 inches, the standard size of a ceiling plank. The known ceiling planks because of their length can be unwieldy to handle, especially on a ladder, and are often installed by one or more skilled installers working on ladders or scaffolding.

Some known ceiling planks have a wood composition core and may be subject to warpage which is exaggerated when the plank is 84 inches long. The known planks must thus be laid out on a flat surface to normalize or flatten such warpage before being installed at a ceiling.

A typical ceiling plank installation can have plural rows of 84 inch ceiling planks, wherein the planks in each row are placed end to end. Because most ceiling dimensions are not an even multiple of the standard 84 inch plank length it is often necessary to cut a. full length ceiling plank to a size that may be much smaller than the 84 inch standard length of a full size ceiling plank. This end to end arrangement can create a disproportionate relationship between the standard full size ceiling plank and the cut ceiling plank, and may give the plank ceiling installation an irregular appearance.

In many known plank ceiling installations the adjacent planks are joined together at the sides and ends by tongue and grove engagement. Two edges of the plank are thus provided with a tongue structure and two edges are provided with a groove structure. Other known joining arrangements can also be used to join the edges of adjacent ceiling planks.

However once a standard size ceiling plank is cut to a shorter length, the cut end is smooth and has no tongue or groove or other joining structure. The cut end of a ceiling plank is thus not engageable with the edge joining structure of an uncut plank, Therefore the cut end of a ceiling plank must he installed at the edge of a ceiling where the cut end does not abut the edge joining structure of an uncut ceiling plank.

Thus it is not feasible to locate the cut and of a cut ceiling plank away from the edge of a ceiling in a plank ceiling installation.

DESCRIPTION OF THE DRAWINGS

In the accompanying drawings.

Corresponding reference numbers indicate corresponding parts throughout the several views of the drawings.

DETAILED DESCRIPTION OF THE INVENTION

Figure 2:
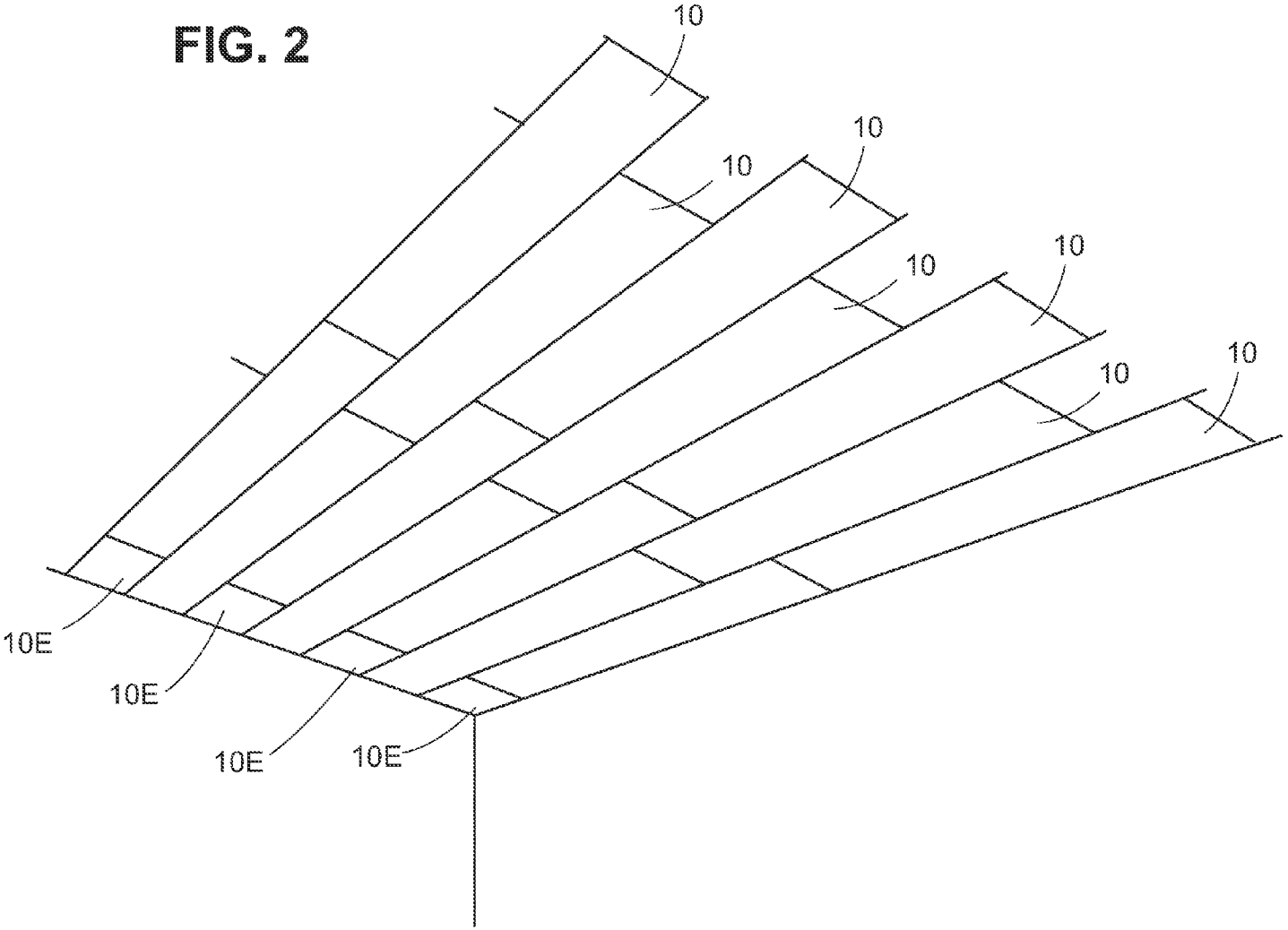
FIG. 2 is a simplified schematic view representing a plank ceiling installation using a ceiling plank incorporating one embodiment of the present invention.

Referring to the drawings, a ceiling plank incorporating one embodiment of the invention is generally indicated by the reference number 10 in FIG. 2.

The ceiling plank 10 is generally rectangular, with a preferred size of approximately five inches by forty-eight inches such that the longer side of the plank 10 is preferably between nine and ten times the length of the shorter side of the plank 10. Thus the plank 10 has two opposite elongated edges 12 and 16 approximately forty-eight inches long, and two opposite end edges 14 and 18 approximately five inches wide. One of the forty-eight inch elongated edges 12 and one of the five inch end edges 14 of the plank 10 are formed with a known edge joining means such as a known tongue construction 15 and the other forty-eight inch elongated edge 16 and five inch end edge 18 are formed with a known complementary groove construction 19. Adjacent ceiling planks 10 in side-by-side and end-to-end arrangement in a plank ceiling installation can thus have a tongue and groove engagement.

The ceiling plank 10 can have a decorative surface 24 (FIGS. 6 and 7), such as a wood grain surface, colored surface or any other suitable design. The peripheral edges 26 (FIG. 7) of the decorative surface are preferably beveled. The core of the ceiling plank 10 is preferably fire retardant class A hardboard.

Figure 3:
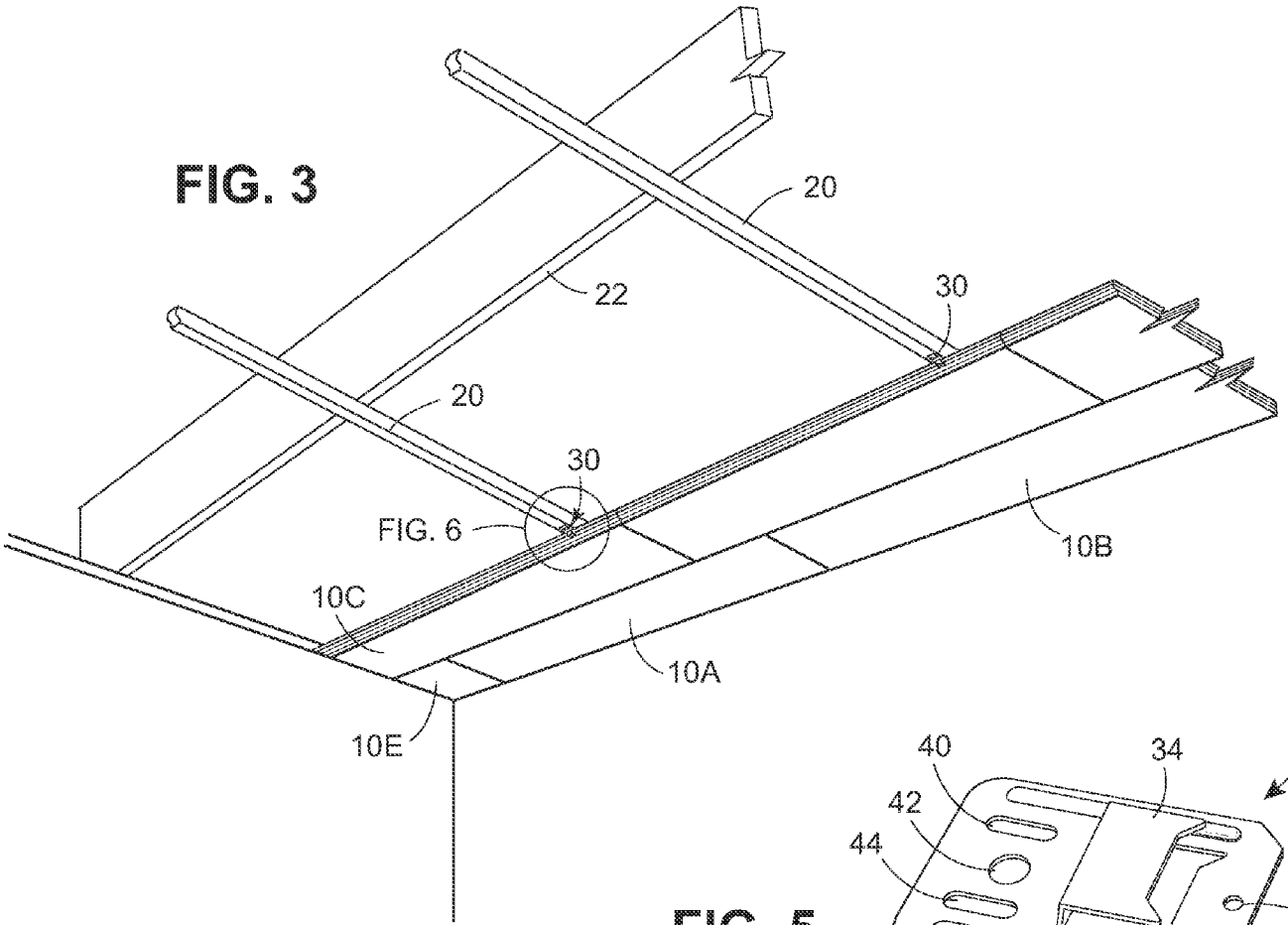
FIGS. 3 and 4 are simplified schematic views representing different stages of a ceiling plank installation using the ceiling plank of the present invention.
Figure 5:
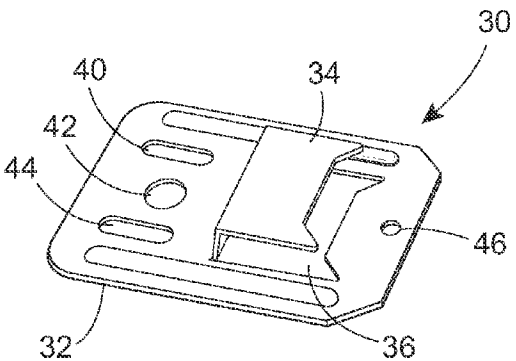
FIG. 5 is a perspective view of a ceiling plank clip used in installing the ceiling planks of FIGS. 2-4.
Figure 4:
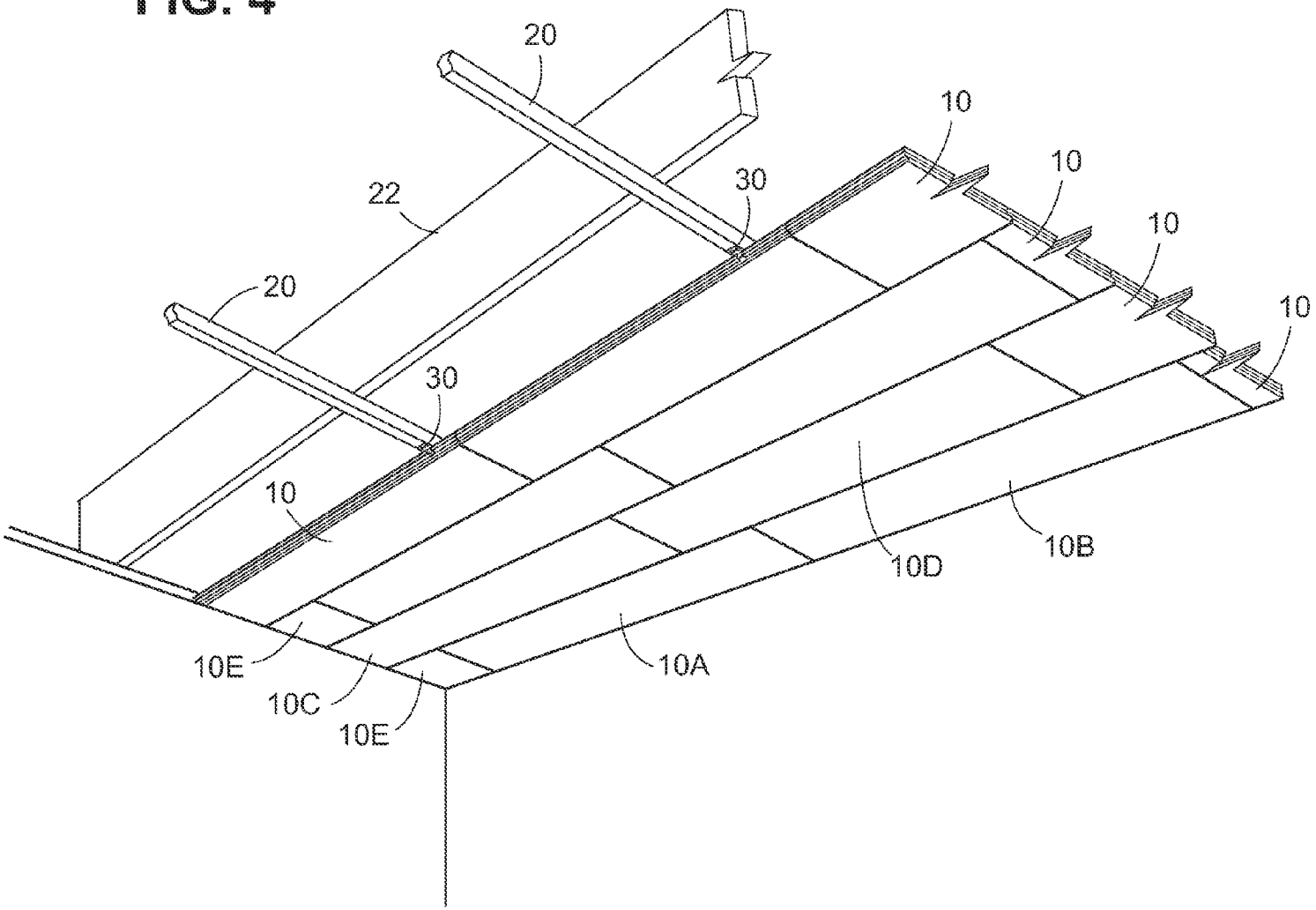

In a plank ceiling installation, the ceiling planks 10 are usually secured to known furring strips 20 (FIG. 3) by ceiling clips 30 (FIGS. 3 and 5). The furring strips 20 are usually joined to known ceiling joists 22 in any suitable known manner, such as by screwing or nailing. In some instances the furring strips 20 are secured directly to a finished ceiling surface.

An initial run of the ceiling planks 10, such as the planks 10A and 10B in FIG. 3, are nailed or screwed directly to the furring strips 20 at one edge of a ceiling and the plank securement nails (not shown) are subsequently covered over with a known edge molding (not shown) at the edge of the ceiling. Subsequent rows of ceiling planks 10, such as 10C and 10D in FIG. 3, are joined to the planks 10A and 10B in side-by-side and end-to-end engagement. The metal ceiling clips 30 are secured to each furring strip 20 to engage the groove portions 19 of the planks in the ceiling plank assembly, and thus enable the grooved portions 19 to support the tongue portions 15 of adjacent planks.

Figure 6:
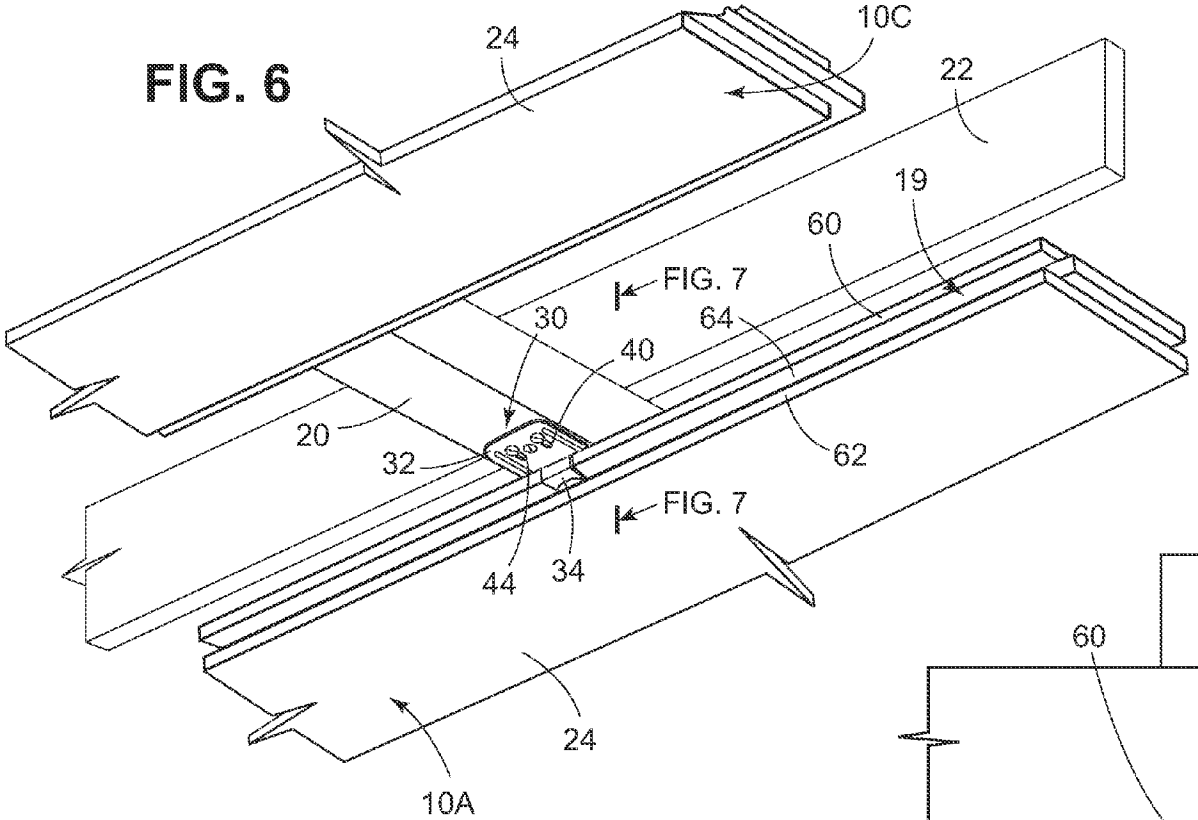
FIG. 6 is an enlarged detail view of the area 6 of FIG. 5.

The ceiling clip 30 (FIG. 5) has a base plate 32 with a bent prong portion 34 that defines a receiving space 36. The clip 30 also includes openings 40, 42, 44 and 46 which can be used to accommodate fasteners, such as screws, nails or staples in one or more of the openings 40, 42, 44 and 46 for fastening the clips 30 to the furring strips 20 as shown in FIG. 6. The ceiling clip 30 is thus positioned such that the prong 34 engages the groove portion 19 of a ceiling plank such as the plank 10A (FIG. 6) to secure the groove portion 19 to the furring strip 20. The groove portion 19 (FIG. 6) thus includes spaced sidewalls 60 and 62 that define a channel 64.

Figure 7:
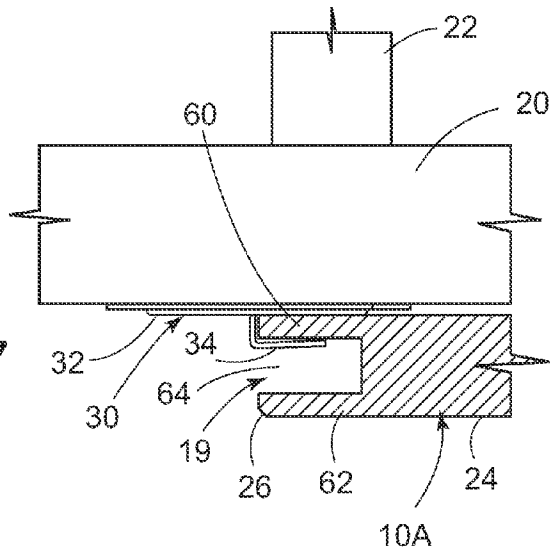
FIG. 7 is a sectional view taken on the line 7-7 of FIG. 6.

The ceiling clip prong 34 is accommodated into the channel 64 to engage the channel sidewall 60. The ceiling clip 30 thus sandwiches the channel sidewall 60 between the prong 34 and the base plate 32. The tongue 15 of another ceiling plank 10C can thus be interengaged in the groove portion 19 of the ceiling plank 10A (FIGS. 3, 6 and 7).

in this manner the ceiling clip 30 secures the groove portion 19 of the ceiling plank 10A to the furring strip 20 to enable the groove portion 19 to receive and support the tongue portion 15 of a next installed ceiling plank 10C in adjacent relationship to the previously installed ceiling plank 10A.

Under this arrangement the plank ceiling installation is progressively installed as shown in FIGS. 2 and 3. It will be noted from FIG. 2 that a cut ceiling plank 10, indicated by the reference number 10E, is installed at an edge of the ceiling. The cut end of the ceiling plank 10E is without a tongue or groove and is nailed or screwed directly to a furring strip 20 (not shown) at the edge of the ceiling. The uncut edge of the ceiling plank 10E with a tongue or groove profile is interengaged with the complementary end of an uncut full size plank 10. The cut ceiling planks, such as the plank 10E, are of a smaller size than the uncut forty-eight inch ceiling plank 10.

Figure 1:
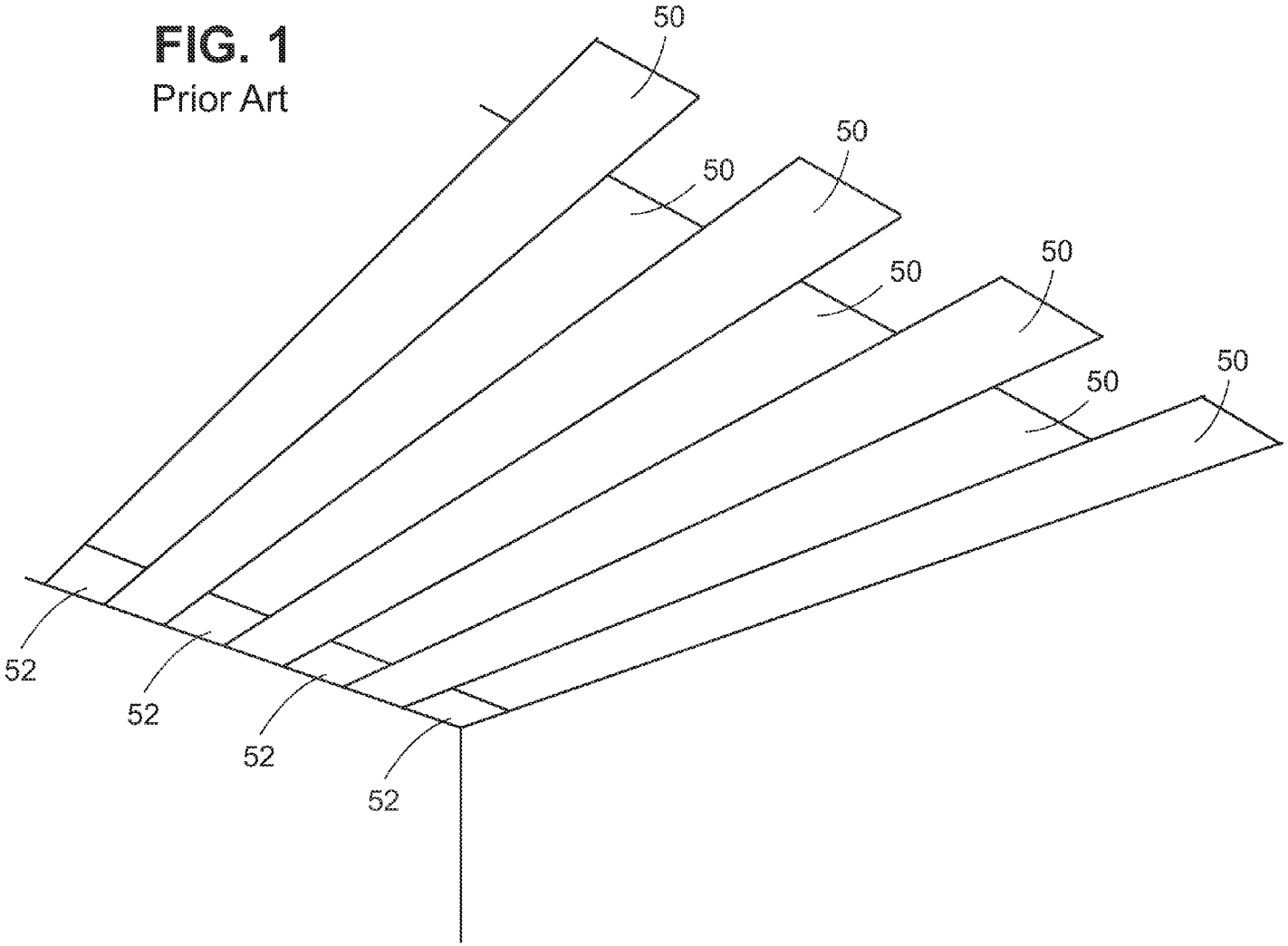
FIG. 1 Prior Art
FIG. 1 is a simplified schematic view representing a prior art plank ceiling installation with known highly elongated standard size ceiling planks.

The prior art ceiling plank installation as shown in FIG. 1 is representative of the known highly elongated eighty-four inch standard ceiling planks 50, with end cut ceiling planks 52 at the edge of the ceiling. It can been seen from FIG. 1 that the size of the cut ceiling planks 52 relative to the known uncut eighty-four inch ceiling planks 50 can be relatively small and disproportional to the uncut eighty-four inch length of the planks 50. In comparison, the cut ceiling planks 10E (FIG. 2) are usually more proportional to the uncut forty-eight inch length of the ceiling planks 10 of the present invention. The cut ceiling planks 10E (FIG. 2) are thus more proportional in size to the uncut forty-eight inch length ceiling planks 10 of the present invention than are the prior art cut planks 52 (FIG. 1) relative to the uncut eighty-four inch length of the known ceiling planks 50.

Furthermore, since the ceiling plank 10 of the present invention is preferably approximately forty-eight inches long as compared the known prior art standard plank length of eighty-four inches there is less likelihood of warpage in the plank 10 as compared to the known eighty-four inch plank 50.

In addition, the forty-eight inch ceiling plank 10 of the present invention, because it is substantially smaller in length than the known standard eighty-four inch ceiling plank 50 and is of less weight than the known ceiling plank 50, is more easily maneuverable and manipulable by one person than the known standard eighty-four inch ceiling plank 50. Thus a single individual do-it-yourselfer working without assistance can easily install a plank ceiling assembly with the forty-eight inch ceiling plank 10 of the present invention as compared with the known highly elongated eighty-four inch standard ceiling planks 50, which generally require one or more skilled installers.

As various changes can be made in the above constructions and methods without departing from the scope of the invention, it is intended that all matter contained in the above description or shown in the accompanying drawings shall be interpreted as illustrative and not in a liming sense.

What is claimed is:

1. A method of installing a ceiling plank assembly comprising, a) providing at least two elongated generally rectangular wood composition or plastic composition ceiling plank members with a predetermined thickness that renders the elongated ceiling plank members with a predetermined resilient flexibility to facilitate installation of the elongated ceiling plank members on a ceiling, b) providing each said elongated ceiling plank member with two opposite elongated side edges and two opposite end edges, c) forming the full length of each of the side edges and each of the end edges with complementary interengaging joining means for joining the two elongated plank members in side-by-side or end-to-end engagement, d) limiting the full length of said elongated side edges to between 9 and 10 times the width of the opposite end edges, e) providing one of the elongated side edges and one of end edges of each of the elongated ceiling plank members with a. groove-like engagement profile including spaced sidewalls and a channel, and providing the other of the elongated side edges and the other of the end edges of each of the elongated ceiling plank members with a complementary tongue-like engagement profile, to permit tongue and groove interengagement of the two elongated ceiling plank members in side-by-side or end-to-end engagement, f) securing a metallic ceiling plank securement clip to a ceiling by providing the ceiling clip with a base and means for securing the base to a ceiling, g) using the ceiling clip that is secured to a ceiling to hold a grooved side edge of one of the ceiling plank members against the ceiling by further providing the ceiling clip with a holding prong for accommodation in the channel of the groove-like engagement profile at the side of the one ceiling plank member to sandwich one of the channel sidewalls between the holding prong and the ceiling, said prong having a first portion projecting from a substantially central portion of said base and a second portion attached to a distal end of said first portion configured to engage one of the channel sidewalls when installed, said second portion having a free edge distal from said first portion terminating in two points with a concave portion extending therebetween, said base further having an aperture corresponding to the shape of said second portion, said aperture defining a perimeter and said first portion is attached to said base at an edge of said perimeter, said securement means including at least one elongated fastener opening in said base, and h) joining the other elongated ceiling plank member in side-by-side or end-to-end engagement with the one elongated ceiling plank member by interengaging the tongue-like engagement profile at the side or end of the other ceiling plank member with the side or end of the one ceiling plank member.

2. The method of claim 1 including providing a third ceiling plank member with a cut end having no tongue-like or groove-like engagement profile, and the opposite sides are provided with respective tongue and groove-like engagement profiles, and the opposite end is provided with one of the tongue-like and groove-like engagement profiles, and locating the third ceiling; plank member such that the cut end is unengaged with any other ceiling plank member in the ceiling plank assembly and the opposite end and opposite sides of the third ceiling plank member are engageable with the complementary engagement profiles of the other said ceiling plank members in side-by-side and end-to-end engagement.

3. The method of claim 1 including providing the ceiling plank members with a display surface having a peripheral edge and beveling the peripheral edge of the display surface.

4. The method of claim 1 including forming the core of the ceiling plank members with fire retardant class A hardboard

5. A ceiling plank assembly comprising, a) at least two elongated generally rectangular wood composition or plastic composition ceiling plank members having a predetermined thickness that provides the elongated ceiling plank members with a predetermined resilient flexibility to facilitate installation of the elongated ceiling plank members on a ceiling, b) each said elongated ceiling plank member having two opposite elongated side edges and two opposite end edges, and the length of said elongated side edges is between 9 and 10 times the width of the opposite end and the edges opposite end edges are approximately 5 inches wide, c) one of the elongated side edges and one of the end edges of each said elongated ceiling plank member being formed with a groove-like engagement profile including spaced sidewalls and a channel, and the other of the elongated side edges and the other of the end edges of each said elongated ceiling plank member being formed with a complementary tongue-like engagement profile, to permit tongue and groove interengagement of the two of said elongated ceiling plank members in side-by side or end-to-end engagement, and d) a metallic ceiling plank securement clip for securement of one of said elongated plank members to a ceiling, said ceiling clip having a base and means for securement of the base of said ceiling clip to a ceiling, and said ceiling clip further including a holding prong for accommodation in the channel of the groove-like engagement profile at the one elongated side edge of one of the elongated ceiling plank members to secure said one elongated ceiling plank member to a ceiling and permit interengagement of the tongue-like engagement profile at the other elongated side edge or at the other end edge of the other said elongated ceiling plank member in side-by-side or end-to-end engagement with the one elongated ceiling plank member said prong having a first portion projecting from a substantially central portion of said base and a second portion attached to a distal end of said first portion configured to engage one of the channel sidewalls when installed, said second portion having a free edge distal from said first portion terminating in two points with a concave portion extending therebetween, said base further having an aperture corresponding to the shape of said second portion, said aperture defining a perimeter and said first portion is attached to said base at an edge of said perimeter, said securement means including at least one elongated fastener opening in said base.

6. The ceiling plank assembly as claimed in claim 5 further including a third ceiling plank member having one end that is a cut end with no tongue-like or groove-like engagement profile, and having opposite sides that include the respective tongue-like and groove-like engagement profiles, and having an opposite end that includes one of the tongue-like and groove-like engagement profiles, and wherein the cut end is unengaged with any other ceiling plank member in the ceiling plank assembly and the opposite end and the opposite sides of the third ceiling plank member are interengagable with the complementary engagement profiles of other said ceiling plank members in side-by-side and end-to-end engagement.

7. The ceiling plank assembly as claimed in claim 5 wherein the ceiling plank members have a display surface with a peripheral edge and the peripheral edge is beveled.

8. The ceiling plank assembly as claimed in claim 5 wherein the core of the ceiling plank members is fire retardant class A hardboard.

* * * * *

UNITED STATES PATENT AND TRADEMARK OFFICE

CERTIFICATE OF CORRECTION

PATENT NO. : 8,806,837 B2
APPLICATION NO. : 13/857625
DATED : August 19, 2014
INVENTOR(S) : Norman Stone It is certified that error appears in the above-identified patent and that said Letters Patent is hereby corrected as shown below:

On the Title Page

In Abstract
Line 1, after “plank” insert --is--.

In the Specification

Column 1,
Line 7, after “directed” insert --to--.

Column 1,
Line 9, change “he” to --be--.

Column 1,
Line 34, change “grove” to --groove--.

Column 3,
Line 32, after “compared” insert --to--.

Column 3,
Line 51, change “liming” to --limiting--.

In the Claims

Column 4,
Line 48, after “ceiling” delete “;”.

Signed and Sealed this
Twenty-fifth Day of November, 2014

Michelle K. Lee

Michelle K. Lee
*Deputy Director of the United States Patent and Trademark Office*

Column 4,
Line 58, after “hardboard” insert --.--.

Column 5,
Line 2, after “end” insert --edges--.

Column 5,
Line 3, change “the edges opposite” to --the opposite--.